United States Patent [19]

Gregory

[11] 3,960,093

[45] June 1, 1976

[54] PORTABLE FORGE

[76] Inventor: Donald R. Gregory, 669 S. Nardo T-4, Solana Beach, Calif. 92075

[22] Filed: Dec. 23, 1974

[21] Appl. No.: 535,183

Related U.S. Application Data

[63] Continuation-in-part of Ser. No. 451,753, March 18, 1974, abandoned.

[52] U.S. Cl. ..... 110/3.5; 432/224; 432/231

[51] Int. Cl.[2] ..... F23D 13/26

[58] Field of Search ..... 110/3.5; 432/224, 225, 432/231

[56] References Cited

UNITED STATES PATENTS

| | | | |
|---|---|---|---|
| 1,194,373 | 8/1916 | Fralick | 110/3.5 |
| 2,173,618 | 9/1939 | Ahlert | 432/231 |

FOREIGN PATENTS OR APPLICATIONS

| | | | |
|---|---|---|---|
| 503,049 | 8/1920 | France | 110/3.5 |

*Primary Examiner*—Kenneth W. Sprague

[57] ABSTRACT

A portable forge having a burner shield with a combustible gas fitting at the top center thereof and an oxygen fitting in a side portion thereof coupled to an oxidizer ring tube with a plurality of oxidizer orifices disposed in the inner portion thereof for directing oxygen in a downward direction therefrom. An inner burner tube surrounds the gas jet orifice or fitting and terminates at the oxidizer ring tube. Disposed directly beneath the burner tube is a mixing chamber terminating in a venturi flare directly beneath the oxidizer ring tube. The mixing chamber terminates in a bottom portion within a top refractory pan which is spatially disposed over a base refractory pan which holds base slab, which in turn, carries a work piece being heated. The burner shield, together with the top refractory pan and the hardware therein, is hingedly attached to the base refractory pan and spatially disposed through a heat shield and top support member. In a second embodiment, a burner tube and mixing chamber are shortened with the oxidizer ring tube disposed at the top of the burner tube.

8 Claims, 10 Drawing Figures

PORTABLE FORGE

RELATED APPLICATIONS

This application is a continuation-in-part of an application filed on Mar. 18, 1974, by Donald R. Gregory for a Portable Forge, Ser. No. 451,753, now abandoned.

BRIEF DESCRIPTION OF THE INVENTION

The present invention relates to a portable forge and more particularly to a portable forge with a focusing oxidizer assembly.

According to the invention, a portable forge is provided having a base for carrying a work piece to be heated. Hingedly attached and spaced vertically disposed above the base a burner shield is provided having a burner tube coaxially mounted therein with a gas fitting at the top portion thereof for the insertion of a combustible gas. An oxygen fitting is coupled into the side of the burner shield and terminates in an oxidizer ring tube which is disposed directly beneath the burner tube. The oxidizer ring tube has a plurality of oxidizer orifices disposed around the center portion on the inside portion and pointed downwardly at approximately 30° with reference to the axis of the burner tube for mixing with the combustible gas and focusing the flame resulting therefrom into a mixing chamber disposed directly beneath the oxidizer ring tube. This has the effect of focusing the flame and intensifying the heat resulting therefrom directly above the work piece and effects a very efficient heat transfer to the work piece.

An object of the present invention is the provision of an improved portable forge.

Another object of the invention is the provision of a portable forge in which the flame and heat is effectively focused directly over a work piece.

A still further object of the invention is the provision of a portable forge which is extremely compact and convenient in use.

Yet another object of the invention is the provision of a portable forge in which heating time is substantially reduced.

A still further object of the invention is the provision of a portable forge which is inexpensive to manufacture and extremely convenient in use.

Other objects and many of the attendant advantages of the present invention will be readily appreciated as the same becomes better understood by reference to the following detailed description when considered in connection with the accompanying drawings in which like reference numerals designate like parts throughout the Figures thereof and wherein.

DETAILED DESCRIPTION OF THE DRAWING

Figure 1:
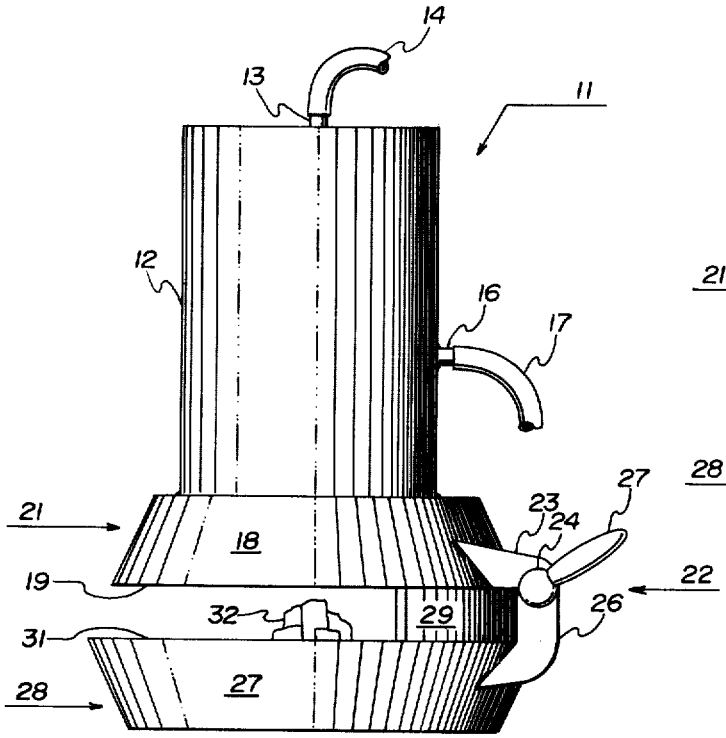
FIG. 1 is a side elevational view of the preferred embodiment of the present invention.
Figure 2:
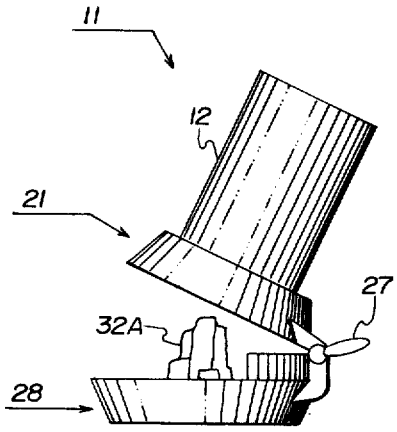
FIG. 2 is a side elevational view of the embodiment of FIG. 1 adjusted for oversized work pieces.

Referring to FIGS. 1 and 2, the portable forge of the instant invention is shown generally at 11 having a burner shield 12 with a gas nipple coupled to the top thereof and a gas line 14 attached thereto. An oxidizer nipple 16 is coupled to an oxygen or inner line 17. Burner shield 12 terminates in a top refractory pan 18 which in turn terminates in a top refractory surface 19. The entire forge top indicated generally at 21 is tiltable through a hinge assembly 22 which includes a hinge bracket 23, tensioning hinge pin 24 supported by hinge support 26, and coupled to locking lever 27. Hinge support 26 is also coupled to base refractory pan 27 of the stationary forge base 28. Base refractory pan 27 carries heat shield and top support member 29 and has a base refractory surface 31 which carries work piece 32.

Figure 3:
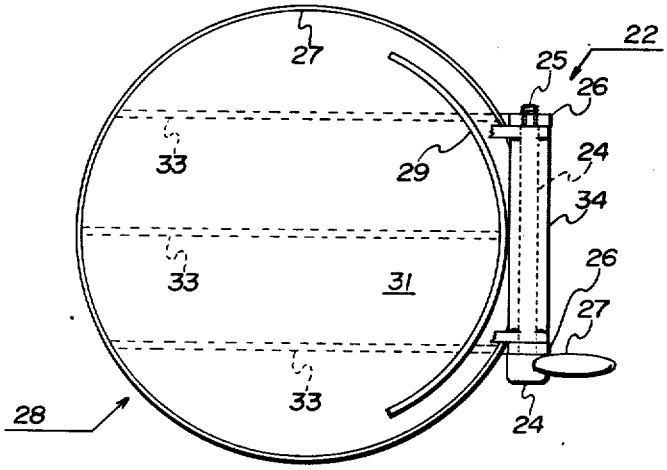
FIG. 3 is a top view of the base of the embodiment of FIG. 1.

Referring to FIG. 3, base assembly 28 is shown having base refractory pan 27 with base surface 31 which carries heat shield and top support member 29. Refractory stabilizer rods 33 are indicated in dotted lines. Locking lever 27 is coupled to bracket tensioning hinge pin 24 within compression tube 34. Tensioning hinge pin 24 is threadably coupled at 25 to bracket 23.

Figure 4:
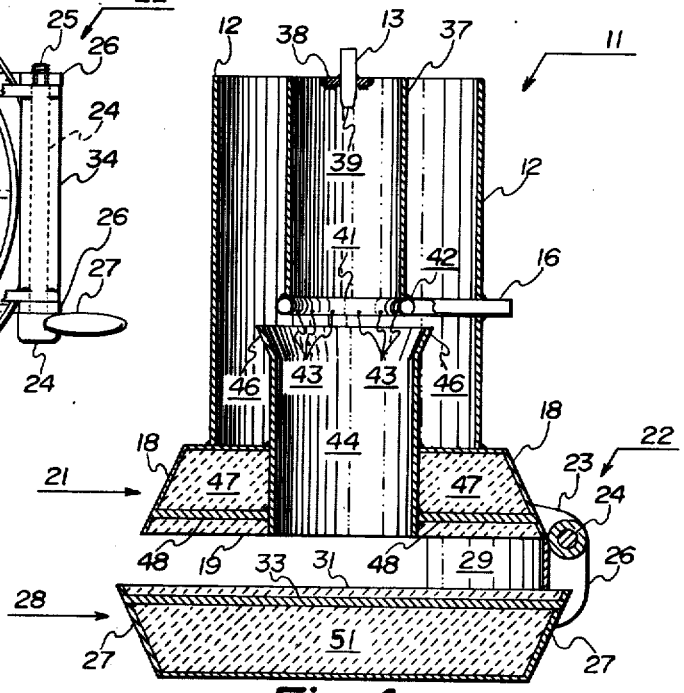
FIG. 4 is a side elevational view partially broken away of the embodiment of FIG. 1.

Referring to FIG. 4, burner shield 12 is shown with burner tube 37 coaxially disposed therein. Gas nipple 13 is shown carried by burner support 38. Gas nipple 13 has a jet orifice 39 disposed in a downward direction. Oxidizer nipple 16 is coupled to oxidizer ring tube 41 in turn is welded at 42 to burner tube 37. Oxidizer ring tube 41 has a plurality of oxidizer orifices 43 disposed around the inner surface of oxidizer ring tube 41 and pointed in a downward direction at approximately a 30° angle with the axis of the burner tube 37. Mixing chamber 44 is disposed directly beneath burner tube 37 and oxidizer ring tube 41 is coaxial therewith. Mixing chamber 44 terminates in its bottom at surface 19 of annular slab 47. Mixing chamber 44 terminates in its top surface in a venturi flare 46. The top refractory pan 18 carries a top refractory annular slab 47 which is reinforced by refractory stabilizer rods 48. Base refractory pan 27 carries base refractory slab 51 which is reinforced by stabilizer rod 33. The base refractory slab 51 carries heat shield and top support member 29. Hinge support 26 carries the hinge assembly 22 which includes compression tube 34 and tensioning hinge pin 24.

Figure 5:
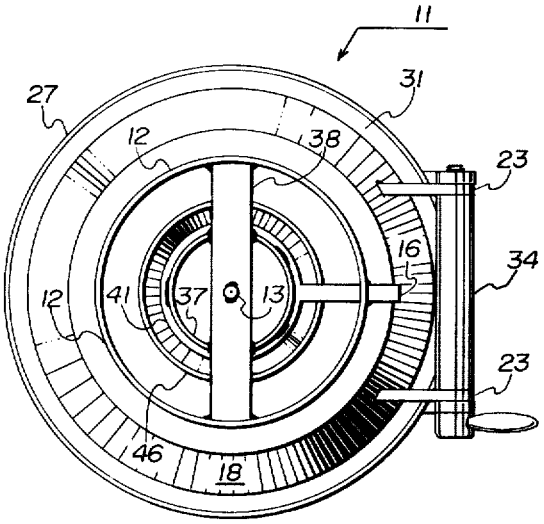
FIG. 5 is a top view of the embodiment of FIG. 1.

Referring to FIG. 5, burner support 38 is coupled to burner shield 12 and carries gas nipple 13. Oxidizer ring 41 is shown disposed directly beneath burner tube 37 and above venturi flare 46 of mixing chamber 44 (not shown). Pan 27 carries base refractory slab 51, the surface of which is visible. Compression tube 34 is coupled to pan 18 via hinge brackets 23.

Figure 6:
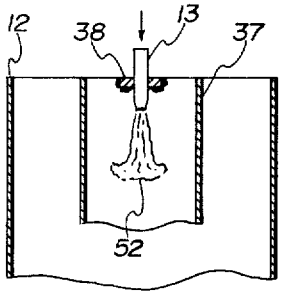
FIG. 6 illustrates initial gas ignition.

Referring to FIG. 6, gas nipple 13 is shown carried by burner support 38 disposed within burner tube 37, which in turn is disposed within burner shield 12. An initial ignition flame is indicated at 52.

Figure 7:
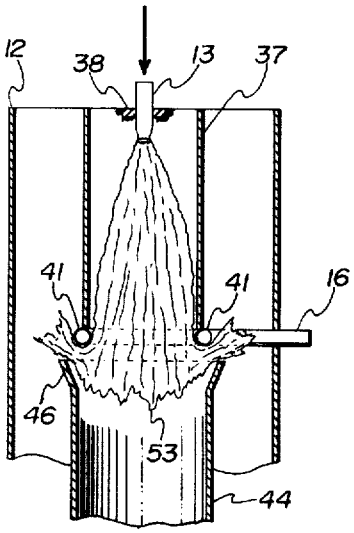
FIG. 7 is a side elevational view in section of the top portion of the embodiment of FIG. 1 illustrating combustion without the introduction of oxygen.

Referring to FIG. 7, a pre-oxidized flame is shown at 53 which is contained within burner tube 37 but spills out between venturi flare 46 of mixing chamber 44 and oxidizer ring 41.

Figure 8:
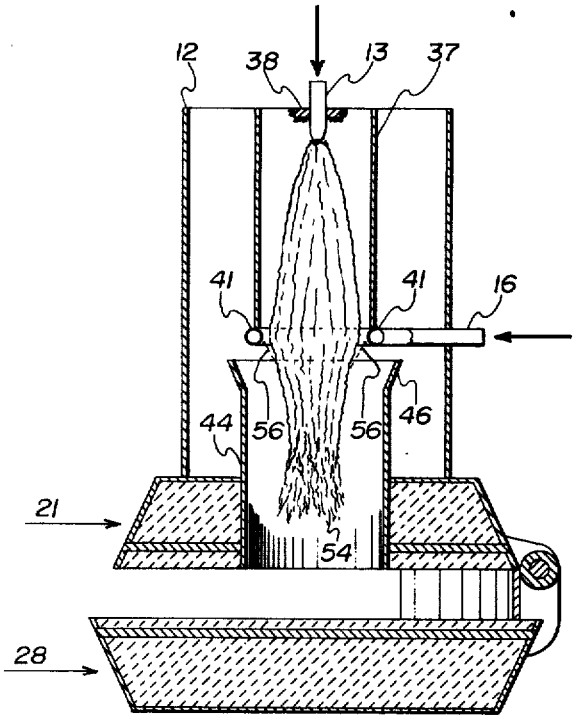
FIG. 8 is a side elevational view in section of the embodiment of FIG. 1 illustrating the focusing effect of the introduction of oxygen on combustion.

Referring to FIG. 8, a flame 54 is shown focused within mixing chamber 44 by oxygen stream 56 from oxidizer ring 41.

Figure 9:
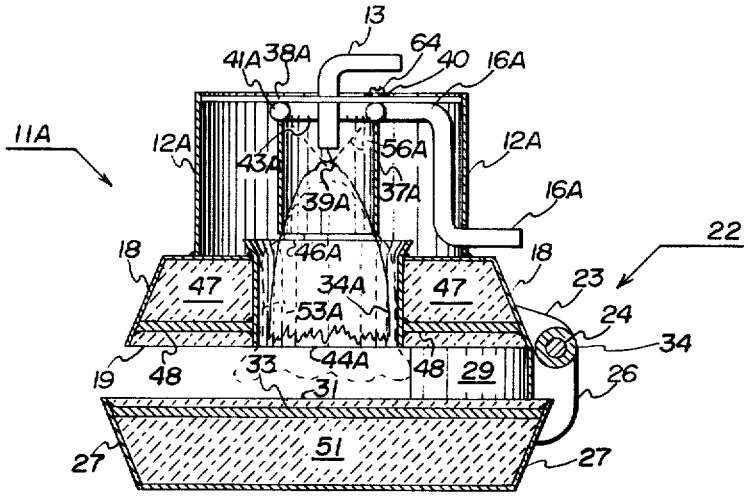
FIG. 9 is a side elevational view in cross section of a modification of the embodiment of FIG. 1.
Figure 10:
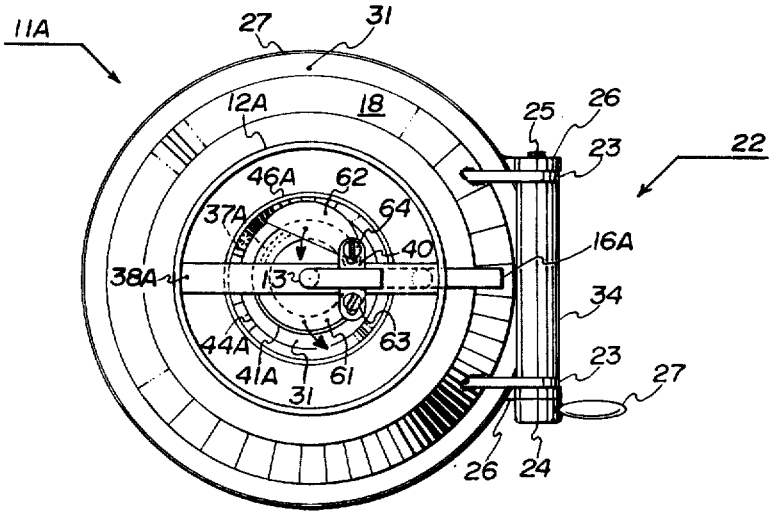
FIG. 10 is a top view of the embodiment of FIG. 9.

Referring to FIGS. 9 and 10, the forge top assembly 21 and the forge base assembly, together with their hinged attachments, are identical with that of the embodiment of FIGS. 1–8. Here, shortened burner shield 12A is shown with shortened burner tube 37 coaxially disposed therein. Gas nipple 13 has a jet orifice 39A disposed beneath oxidizer ring tube 41A and the top of burner tube 37A. Oxidizer ring tube 41A is carried by the top surface (or in proximity to the top surface) of burner tube 37A. Shortened mixing chamber 74A terminates at its top portion in a venturi flare 46A and at surface 19 of annular slab 47 of top assembly 21. Dotted lines 56A indicate the flow of oxygen from the oxidizer orifices 43A which converge at the top of flame 54A.

Burner support 38A carries a support member 40 which has a pair of elongated slots hidden (not shown) by mounting screws 63 and 64. Mounting screws 63 and 64 are coupled to flue vanes 61 and 62 which result in their being rotatably coupled to mounting member 40. Flame 53A, indicated by dotted lines, illustrates the flame when oxidizer ring 41A is not supplied by oxygen.

OPERATION

Referring to FIGS. 1–8, it can be seen that upon initial ignition (FIG. 6) of gas through gas nipple 13, and the application of more gas flow (FIG. 7), the flame shown at 53 is disoriented and spills over between the oxidizer tube 41 and the venturi flare 46 of mixing chamber 44. This effects a relatively low heat with a long heating period which is common in the majority of prior art forges. Upon application of oxygen through oxidizer nipple 16, as indicated by the arrow in FIG. 8, the combustion is not only more complete but a focusing effect is enjoyed as indicated by the oxygen flow of dotted lines 56. This places the major heating portion of the flame 54 within mixing chamber 44 and in heating disposition with any work placed on the surface 31 (FIG. 1) of base refractory slab 51 (FIG. 4). It has been found that larger work pieces then will be accommodated between the top refractory surface 19 (FIG. 1) and the base refractory surface 31 can be accomodated by rotating the tiltable forge top 21 (FIG. 2) to allow for a larger displacement between the two surfaces, without excessively sacrificing heat efficiency. It has also been found that the introduction of air into oxidizer nipple 16 will perform satisfactorily in that the focusing effect of the main part of the flame is still well within mixing chamber 44, although the combustion is not quite as complete.

Referring back to FIGS. 9 and 10, as can be seen, the burner tube 37A has been shortened along with the mixing chamber 44A. This allows for disposing the oxidizer ring 41A on the upper surface of shortened burner tube 37A. It further allows for utilizing atmosphere oxygen by opening flue vanes 61 and 62 (in the position shown by flue vane 62) to allow air to pass down burner tube 37A and ignite approximately as indicated by dotted lines 53A. This modification is extremely convenient, particularly when utilized in environments where an oxygen supply may not be available or may be depleted.

It should be understood, of course, that the foregoing disclosure relates to only a preferred embodiment of the present invention, and that it is intended to cover all changes and modifications of the example of the invention herein chosen, for the purposes of the disclosure, which do not constitute departures from the spirit and scope of the invention.

The invention claimed is:

1. A portable forge comprising:

a forge base;

a forge top assembly spatially disposed above said forge base for receiving a work piece between said forge base and said forge top assembly;

said forge top assembly including a burner shield;

a burner tube vertically disposed within said burner shield in a top portion thereof;

a gas nipple disposed centrally at the top portion of said burner tube, said gas nipple having a jet orifice pointing downwardly therefrom;

an oxidizer ring tube horizontally disposed in proximity with said burner tube and having a plurality of oxidizer orifices therein pointed downwardly and towards the axis of said oxidizer ring tube;

an oxidizer nipple coupled to said oxidizer ring tube;

a mixing chamber disposed beneath said burner tube;

a slab surrounding at least the bottom of said mixing chamber and terminating in the bottom surface of said forge top assembly.

2. The portable forge of claim 1 and further including:

a hinge assembly hingedly attaching said base member and said top assembly.

3. The portable forge of claim 2 and further including:

a heat shield and top support member carried by said forge base member in proximity with said hinge assembly and dimensioned for supportively carrying said top assembly and shielding said hinge assembly from heat.

4. The portable forge of claim 1 wherein:

said mixing chamber terminates at its upper portion in a venturi flare disposed outwardly of said burner tube.

5. The portable forge of claim 1 wherein:

said oxidizer ring tube is disposed in the top of said burner tube.

6. The portable forge of claim 1 wherein:

said oxidizer ring tube is disposed beneath said burner rube.

7. The portable forge of claim 1 wherein:

said mixing chamber terminates at its upper portion in a venturi flare disposed outwardly of said oxidizer tube.

8. The portable forge of claim 1 and further including:

at least one adjustable flue vane disposed and adjustably closing the top of said burner tube and for adjustably opening the top of said burner tube to atmosphere.

* * * * *